US009079140B2

(12) United States Patent
Xiong et al.

(10) Patent No.: US 9,079,140 B2
(45) Date of Patent: Jul. 14, 2015

(54) COMPACT INTERACTION CHAMBER WITH MULTIPLE CROSS MICRO IMPINGING JETS

(75) Inventors: Renqiang Xiong, Newton, MA (US); John Michael Bernard, Stoughton, MA (US)

(73) Assignee: MICROFLUIDICS INTERNATIONAL CORPORATION, Newton, MA (US)

( * ) Notice: Subject to any disclaimer, the term of this patent is extended or adjusted under 35 U.S.C. 154(b) by 1127 days.

(21) Appl. No.: 13/085,903

(22) Filed: Apr. 13, 2011

(65) Prior Publication Data

US 2012/0263012 A1 Oct. 18, 2012

(51) Int. Cl.

| | |
|---|---|
| ***B01F 5/04*** | (2006.01) |
| ***B01F 5/02*** | (2006.01) |
| ***B01F 13/00*** | (2006.01) |

(52) U.S. Cl.

CPC ..... *B01F 5/0256* (2013.01); *B01F 13/0059* (2013.01); *B01F 2215/0032* (2013.01)

(58) Field of Classification Search

CPC ..... B01F 13/0059; B01F 2215/0032; B01F 5/0256

USPC ..... 366/315, 316, 173.1, 165.1, 165.5, 340, 366/160.2, 177.1

See application file for complete search history.

(56) References Cited

U.S. PATENT DOCUMENTS

| | | | | |
|---|---|---|---|---|
| 4,533,254 | A | | 8/1985 | Cook et al. |
| 4,634,134 | A | | 1/1987 | Entrikin |
| 4,684,072 | A | | 8/1987 | Nelson et al. |
| 4,746,069 | A | | 5/1988 | Entrikin et al. |
| 4,908,154 | A | | 3/1990 | Cook et al. |
| 5,314,506 | A | | 5/1994 | Midler, Jr. et al. |
| 5,417,956 | A | | 5/1995 | Moser |
| 5,466,646 | A | | 11/1995 | Moser |
| 5,533,254 | A | | 7/1996 | Gallo et al. |
| 5,534,328 | A | * | 7/1996 | Ashmead et al. ..... 428/166 |
| 5,570,955 | A | | 11/1996 | Swartwout et al. |

(Continued)

FOREIGN PATENT DOCUMENTS

| | | |
|---|---|---|
| JP | H8-117578 | 5/1996 |
| JP | H9-169026 | 6/1997 |

(Continued)

OTHER PUBLICATIONS

International Search Report and Written Opinion dated Jul. 13, 2012 issued for International PCT Application No. PCT/US12/33323, 7 pages.

(Continued)

*Primary Examiner* — Tony G Soohoo

(74) *Attorney, Agent, or Firm* — K&L Gates LLP

(57) ABSTRACT

A mixing assembly includes an inlet, an outlet and a mixing chamber, the inlet is fluidly connected to the outlet through a plurality of micro fluid flow paths in a direction perpendicular from the inlet. The micro fluid flow paths fluidly connect to the perpendicular inlet via a transition portion. The micro fluid flow paths are constructed radially inwardly to a concentration area in the mixing chamber. By directing multiple fluid flows to a concentrated area within the mixing chamber at high speeds, the energy dissipated at the point of collision is maximized, which helps to increase consistency and quality of mixing, and to reduce particle size of the fluid in the mixing chamber.

24 Claims, 8 Drawing Sheets

(56) References Cited

U.S. PATENT DOCUMENTS

| | | | | |
|---|---|---|---|---|
| 5,578,279 | A | 11/1996 | Dauer et al. | |
| 5,595,712 | A * | 1/1997 | Harbster et al. | 422/129 |
| 5,615,949 | A | 4/1997 | Morano et al. | |
| 5,620,147 | A | 4/1997 | Newton | |
| 5,672,821 | A * | 9/1997 | Suzuki | 73/202 |
| 5,826,981 | A * | 10/1998 | Fowler et al. | 366/337 |
| 5,887,977 | A * | 3/1999 | Morikawa | 366/340 |
| 5,984,519 | A * | 11/1999 | Onodera et al. | 366/340 |
| 6,159,442 | A | 12/2000 | Thumm et al. | |
| 6,221,332 | B1 | 4/2001 | Thumm et al. | |
| 6,457,854 | B1 * | 10/2002 | Koop et al. | 366/336 |
| 6,558,435 | B2 | 5/2003 | Am Ende et al. | |
| 6,592,696 | B1 * | 7/2003 | Burdon et al. | 156/89.12 |
| 6,607,784 | B2 | 8/2003 | Kipp et al. | |
| 6,655,829 | B1 * | 12/2003 | Vanden Bussche et al. | 366/165.1 |
| 6,869,617 | B2 | 3/2005 | Kipp et al. | |
| 6,932,914 | B2 | 8/2005 | LeClair | |
| 6,960,307 | B2 | 11/2005 | LeClair | |
| 6,977,085 | B2 | 12/2005 | Werling et al. | |
| 7,080,937 | B1 * | 7/2006 | Salmela et al. | 366/341 |
| 7,147,364 | B2 | 12/2006 | Oohashi et al. | |
| 7,297,288 | B1 | 11/2007 | LeClair | |
| 7,326,054 | B2 | 2/2008 | Todd et al. | |
| 7,829,039 | B2 | 11/2010 | Schubert et al. | |
| 8,740,450 | B2 * | 6/2014 | Mogami et al. | 366/340 |
| 2003/0039169 | A1 * | 2/2003 | Ehrfeld et al. | 366/336 |
| 2003/0206959 | A9 | 11/2003 | Kipp et al. | |
| 2004/0125689 | A1 * | 7/2004 | Ehrfeld et al. | 366/165.1 |
| 2004/0266890 | A1 | 12/2004 | Kipp et al. | |
| 2005/0191359 | A1 | 9/2005 | Goldshtein et al. | |
| 2005/0213425 | A1 | 9/2005 | Wang et al. | |
| 2006/0028908 | A1 | 2/2006 | Suriadi et al. | |
| 2006/0151899 | A1 | 7/2006 | Kato et al. | |
| 2007/0007204 | A1 * | 1/2007 | Schanz et al. | 210/634 |
| 2007/0140042 | A1 * | 6/2007 | Schanz et al. | 366/130 |
| 2007/0291581 | A1 | 12/2007 | Ehrfeld et al. | |
| 2008/0038333 | A1 | 2/2008 | Magadassi et al. | |
| 2008/0106968 | A1 * | 5/2008 | Schanz et al. | 366/134 |
| 2009/0269250 | A1 | 10/2009 | Panagiotou et al. | |
| 2009/0297565 | A1 | 12/2009 | Muller et al. | |
| 2010/0067323 | A1 | 3/2010 | Blom et al. | |
| 2012/0175442 | A1 * | 7/2012 | Xiong et al. | 241/15 |
| 2012/0263012 | A1 * | 10/2012 | Xiong et al. | 366/134 |
| 2014/0241960 | A1 * | 8/2014 | Mochizuki | 422/633 |

FOREIGN PATENT DOCUMENTS

| | | |
|---|---|---|
| JP | 2003-311136 | 11/2003 |
| JP | 2006-021471 | 1/2006 |
| JP | 2006-341146 | 12/2006 |
| JP | 2008-037842 | 2/2008 |
| JP | 2008-081772 | 4/2008 |
| WO | 99/07466 | 2/1999 |
| WO | 2005/018687 | 3/2005 |
| WO | 2007/051520 | 5/2007 |
| WO | 2007/148237 | 12/2007 |

OTHER PUBLICATIONS

Sonolator Product Literature, 10 pages.

Gruverman, Breakthrough Ultraturbulent Reaction Technology Opens Frontier for Developing Life-Saving Nanometer-Scale Suspensions & Dispersions, Ultraturbulent Reaction Technology publication, Jan./Feb. 2003, vol. 3, No. 1 (4 pages).

Gruverman, A Drug Delivery Breakthrough—Nanosuspension Formulations for Intravenous, Oral & Transdermal Administration of Active Pharmaceutical Ingredients, Nanosuspension Formulations publication, Sep. 2004, vol. 4, No. 7, ppl. 58-59.

Gruverman, Nanosuspension Preparation and Formulation, Nanosuspension Formulation publication, Sep. 2005, vol. 5, No. 8, pp. 1-4.

Gruverman, Optimizing Drug Delivery—Formulation Development and Scaleable Manufacturing Methodology, Nanoemulsions and Nanosuspensions Prepared by Ultrahigh-Shear Fluid Processing, Presentation at Particles 2006, May 14, 2006, total 43 pages.

Gruverman et al., Production of Nanostructures Under Ultraturbulent Collision Reaction Conditions—Application to Catalysts, Superconductors, CMP Abrasives, Ceramics and Other Nanoparticles, undated.

Panagiotiou, et al., Production of Stable Drug Nanosuspensions Using Microfluidics Reaction Technology, Poster Session, single page, undated.

Gruverman, Advances in Continuous Chemical Reactor Technology, Oct. 30, 2006, retrieved online Jun. 2, 2009, URlhttp://aimediaserver4com/chemeng/pdf/feature-oct06.pdf, Figure V, p. 5.

PCT International Search Report dated Jun. 15, 2009 (PCT/US2009/041511), 2 pages.

Johnson, et al., Chemical Processing and Micromixing in Confined Impinging Jets, AIChE Journal, vol. 49, No. 9, Sep. 2003, pp. 2264-2282.

U.S. Appl. No. 12/986,477, filed Jan. 7, 2011.

U.S. Appl. No. 13/085,939, filed Apr. 13, 2011.

* cited by examiner

COMPACT INTERACTION CHAMBER WITH MULTIPLE CROSS MICRO IMPINGING JETS

CROSS-REFERENCE TO RELATED APPLICATIONS

This application expressly incorporates by reference, and makes a part hereof, U.S. patent application Ser. No. 12/986,477 and the U.S. patent application Ser. No. 13/085,939, entitled: "Interaction Chamber with Flow Inlet Optimization", filed on behalf of the same inventors concurrently with the present application.

COPYRIGHT NOTICE

A portion of the disclosure of this patent document contains material which is subject to copyright protection. The copyright owner has no objection to the photocopy reproduction of the patent document or the patent disclosure in exactly the form it appears in the Patent and Trademark Office patent file or records, but otherwise reserves all copyright rights whatsoever.

BACKGROUND OF THE INVENTION

For certain pharmaceutical applications, manufacturers need to process and mix expensive liquid drugs for testing and production using the lowest possible volume of fluid to save money. Current mixing devices operate by pumping the fluid to be mixed under high pressure through an assembly that includes two mixing chamber elements secured within a housing. Each of the mixing chamber elements provides fluid paths through which the fluid travels prior to being mixed together. In current mixing chambers, the mixing chamber elements include a plurality of parallel inlet fluid paths on one side of the mixing chamber and a plurality of complimentary parallel inlet fluid paths on the opposite side of the mixing chamber. In current mixing chambers, the flow from each parallel fluid path collides with the flow from the respective opposite-facing fluid path to mix the fluid in the mixing chamber under high pressure, resulting in the high energy dissipation. As the energy dissipated at the time of mixture is increased, the quality and consistency of the resulting mixture is improved.

DETAILED DESCRIPTION

Figure 1:
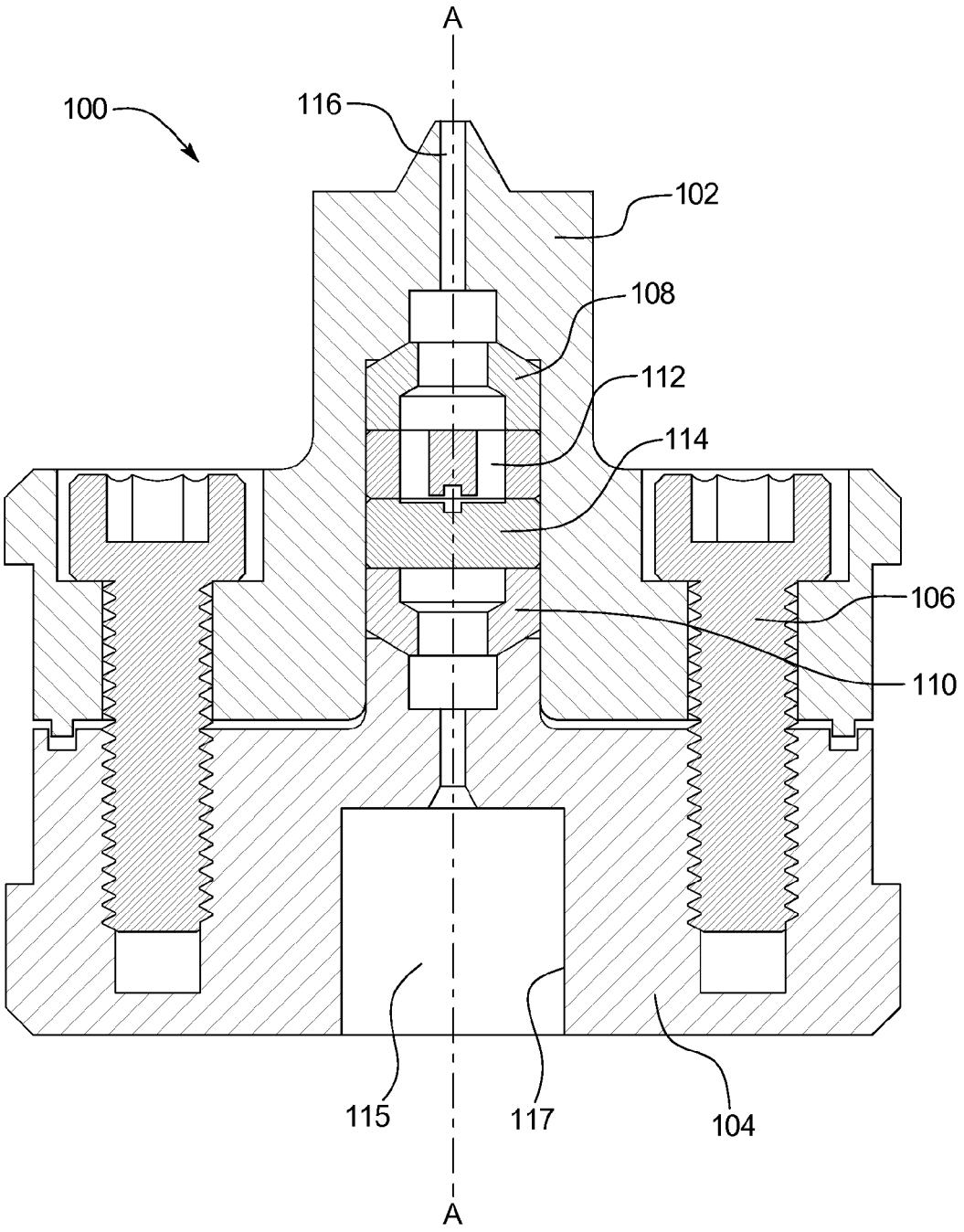
FIG. 1 is a cross-sectional view of an example assembled interaction chamber taken along line X-X of FIG. 2, according to one example embodiment of the present invention.

The present disclosure is generally directed to an interaction chamber that includes mixing chamber elements with a plurality of parallel flow inlets, each of which may be configured to direct fluid along a first parallel path in a first direction, and then along a plurality of second impinging paths in a second direction that may extend substantially perpendicularly to the first direction. Each of the second impinging paths extends from one of the respective first parallel paths. Unlike the plurality of parallel flow paths, the second impinging paths are not arranged parallel to one another, but may be arranged to extend radially outwardly from a concentrated area in the mixing chamber to each of the respective first parallel paths. The orientation of the plurality of second impinging paths cause the multiple fluid flows carried within the paths to converge to the concentrated area in the mixing chamber. By converging each of the multiple fluid flow paths to one single concentrated area in the mixing chamber, the total energy dissipated from the collision of the all of the flow paths is maximized. As discussed above, each parallel flow path in the prior art includes a complementary parallel flow path with which to collide in the mixing chamber. In some prior art devices, there are three or more parallel flow path pairs, and accordingly, three or more associated points of collision of two flows in the mixing chamber.

As the amount of energy dissipated at the point of collision increases, the quality and consistency of the mixing of the fluid also increases. The impinging flow paths of the present invention therefore result in the superior mixture of fluid using less energy than current mixing devices. By optimizing the quality of the mixture as a result of maximizing energy dissipation in the concentrated area, the fluid flow rate entering the mixing chamber elements can be decreased while keeping all other factors constant in comparison with the more inefficient mixing technology employed in current devices. Increasing the interaction of the flow paths by converging them to a single area results in maximized energy dissipation and increased quality of mixing.

The impinging fluid flow paths are part of an interaction chamber, as described in U.S. patent application Ser. No. 12/986,477, which is incorporated herein by reference. Also incorporated herein by reference is U.S. patent application Ser. No. 13/085,939 directed to a mixing chamber element with a curved inlet configuration. It should be appreciated, however, that the impinging fluid flow path embodiments described herein can be implemented into any suitable mixing device, and are not limited to the interaction chamber illustrated and discussed or the curved inlet configuration illustrated and discussed in Ser. No. 13/085,939.

The interaction chamber of the present disclosure includes, among other components: a first housing; a second housing; an inlet retaining member; an outlet retaining member; an inlet mixing chamber element; and an outlet mixing chamber element. When assembled, the inlet retaining member and the outlet retaining member are situated facing one another within a first opening of the first housing. The inlet and outlet mixing chamber elements reside adjacent one another and between the inlet and outlet retaining members within the first opening. The second housing is fastened to the first housing such that a male protrusion on the second housing is inserted into the first opening making contact with the second retaining member. When the first and second housings are fastened together, the first retaining member and second retaining member are forced toward one another, thereby compressing the inlet and outlet retaining members and properly aligning the inlet and outlet mixing chamber elements together. The mixing chamber elements are further secured for high pressure mixing by the hoop stress exerted on the inlet and outlet mixing chamber elements by the inner wall of the first opening, as will be explained in further detail below.

As discussed below, in the interaction chamber of the present disclosure, the mixing chamber elements are secured using both compression from the torque of fastening two housings together as well as hoop stress of the inner walls of the first housing directed radially inwardly on the mixing chamber elements. However, rather than using a tube member that would need to be stretched to hold the mixing chamber elements radially, the first housing is heated prior to insertion of the mixing chamber elements, and allowed to cool and contract once the mixing chamber elements are inserted and aligned. By securing the mixing chamber elements with the hoop stress of the first housing applied as a result of thermal expansion and contraction, the torque required to compress the mixing chamber elements together is significantly reduced. Therefore, the interaction chamber can be reduced in size, number of components, and complexity that results in a significant reduction in holdup volume.

Figure 2:
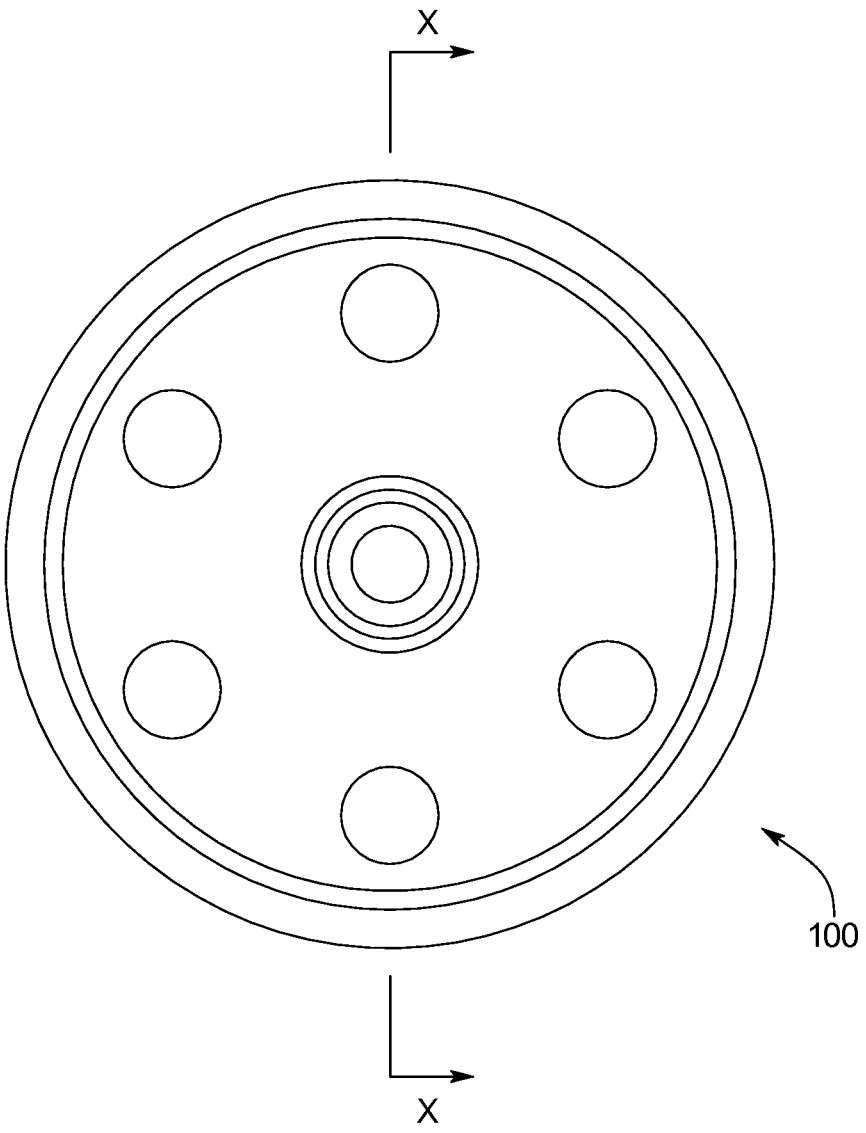
FIG. 2 is a top view of the assembled example interaction chamber according to one example embodiment of the present invention.
Figure 3:
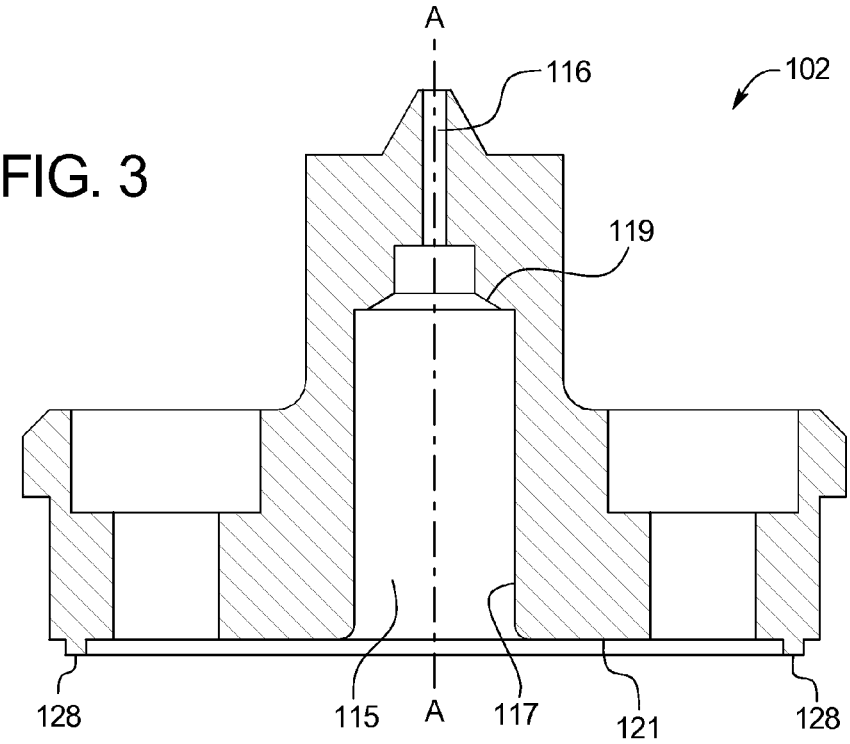
FIG. 3 is a cross-sectional view of the first housing of the example interaction chamber taken along line X-X of FIG. 2 according to one example embodiment of the present invention.
Figure 4:
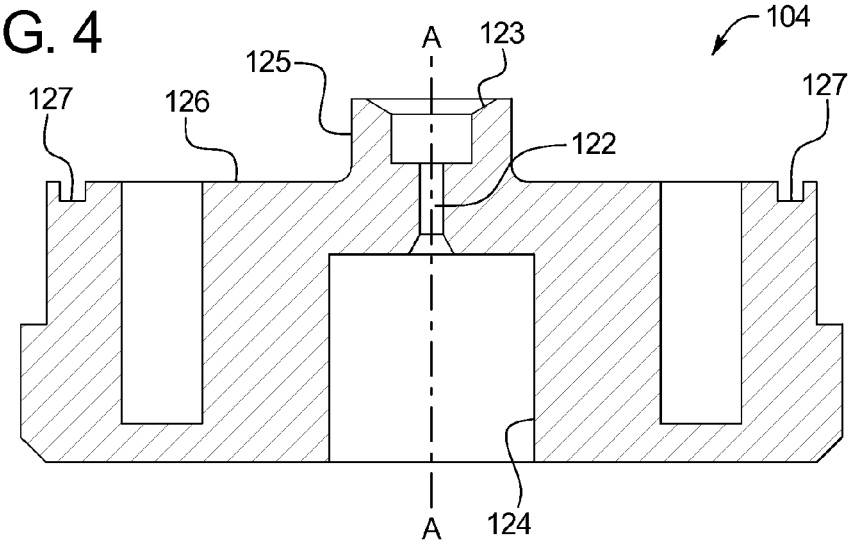
FIG. 4 is a cross-sectional view of the second housing of the example interaction chamber taken along line X-X of FIG. 2 according to one example embodiment of the present invention.
Figure 5:
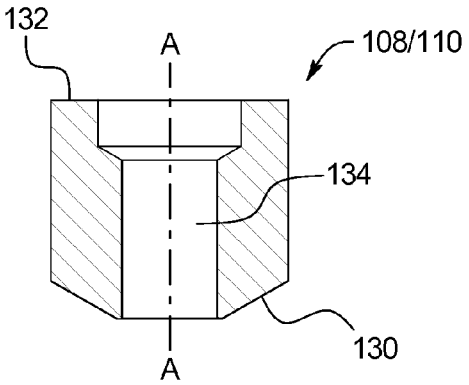
FIG. 5 is a cross-sectional view of the retaining element of the example interaction chamber taken along line X-X of FIG. 2 according to one example embodiment of the present invention.
Figure 10:
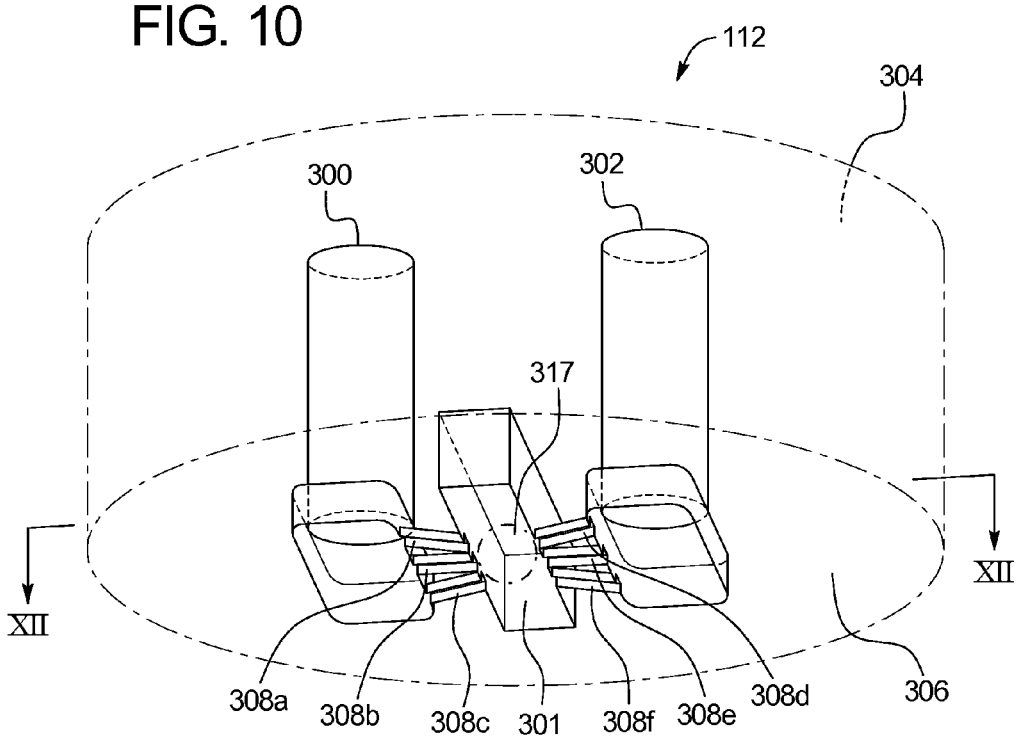
FIG. 10 is a perspective cross-sectional view of an inlet mixing chamber element according to one example embodiment of the present invention.
Figure 11:
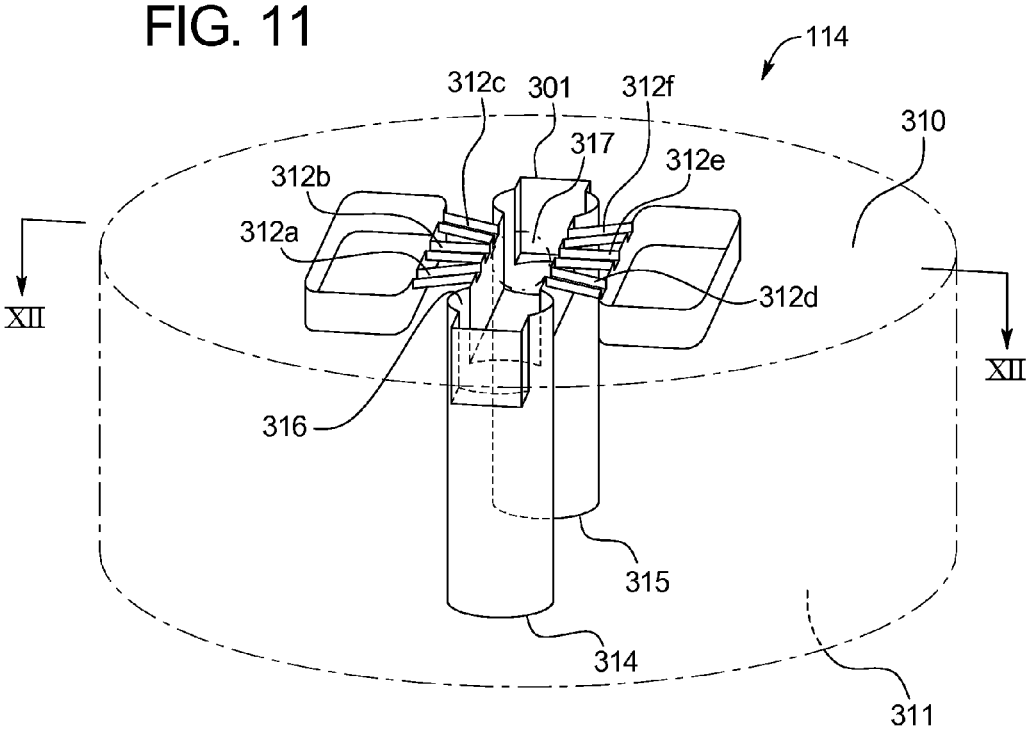
FIG. 11 is a perspective cross-sectional view of an outlet mixing chamber element according to one example embodiment of the present invention.
Figure 12:
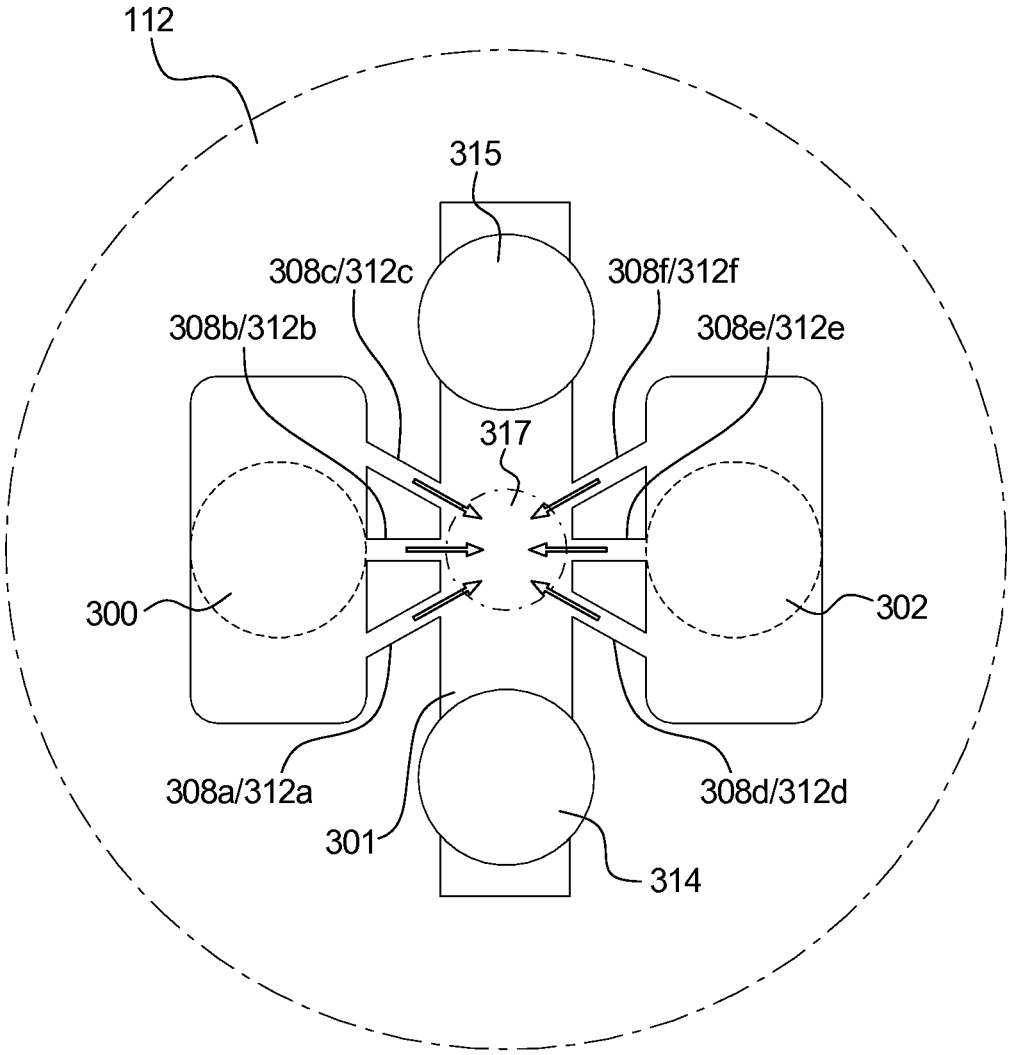
FIG. 12 is a top cross-sectional view of the inlet and outlet mixing chamber elements taken along line XII-XII of FIGS. 10 and 11 according to one example embodiment of the present invention.

Referring now to FIGS. 1 to 5 and 10 to 12, various example embodiments of the interaction chamber are illustrated. FIG. 2 illustrates a cross-sectional view of the assembled interaction chamber assembly 100 taken along the line X-X of the top view shown in FIG. 2. FIG. 3 illustrates the first housing 102 in detail, FIG. 4 illustrates the second housing 104 in detail and FIG. 5 illustrates the inlet/outlet retainer 108/110 in detail. FIG. 10 illustrates the inlet mixing chamber element 112 in detail and FIG. 11 illustrates the outlet mixing chamber element 114 in detail. FIG. 12 illustrates a cross-sectional side view of the inlet mixing chamber element 112 and the outlet mixing chamber element 114 assembled together.

As seen in FIG. 1, the assembled interaction chamber 100 may include a generally cylindrically shaped first housing 102 and a generally cylindrically shaped second housing 104. The first housing 102 is configured to be operably fastened to the second housing 104 using any sufficient fastening technology. In the illustrated example embodiment, the first housing 102 is fastened to the second housing 104 with a plurality of bolts 106 arranged in a circular array around a central axis A. It should be appreciated that the generally cylindrically shaped first housing 102 and the generally cylindrically shaped second housing 104 share central axis A when assembled.

Between the first housing 102 and the second housing 104 resides an inlet retainer 108, an outlet retainer 110, an inlet mixing chamber element 112 and outlet mixing chamber element 114. The inlet retainer 108 is arranged adjacent to the inlet mixing chamber element 112. The inlet mixing chamber element 112 is arranged adjacent to the outlet mixing chamber element 114, which is arranged adjacent to the outlet retainer 110. When the interaction chamber 100 is assembled, bolts 106 clamp the first housing 102 to the second housing 104, thereby compressing the inlet mixing chamber element 112 and outlet mixing chamber element 114 between the inlet retainer 108 and the outlet retainer 110.

After assembly, an unmixed fluid flow is directed into inlet 116 of the first housing 102, and through an opening 118 in inlet retainer 108. As discussed in more detail below, the unmixed fluid flow is then directed though a plurality of small pathways in the inlet mixing chamber element 102 in the direction of the fluid path. The fluid then flows in a direction parallel to the face of the inlet mixing chamber element 112 and the face of the adjacent outlet mixing chamber element 114 through a plurality of microchannels formed between the inlet mixing chamber element 112 and the outlet mixing chamber element 114. The fluid is mixed when the plurality of micro channels converge. The mixed fluid is directed through a plurality of small pathways in the outlet mixing chamber element 114, through an opening 120 in outlet retainer 110, and through outlet 122 of the second housing 104. As discussed in greater detail below, the plurality of small pathways of one embodiment converge to a concentrated area in the mixing chamber for to maximize and optimize mixing.

It should be appreciated that the plurality of bolts 106 used to fasten the first housing 102 to the second housing 104 provide a clamping force sufficient to compress the inlet mixing chamber element 112 and the outlet mixing chamber element 114 so that the microchannels formed between the two faces are fluid tight. However, due to the high pressure and the high energy dissipation resulting from the mixing taking place between the inlet mixing chamber element 112 and the outlet mixing chamber element 114, the compression force applied by the torqued bolts 106 alone may not be sufficient to hold the mixing chamber elements static within the first opening of the first housing 102 during mixing. Thus, in addition to the compressive force applied by the bolts 106, the mixing chamber elements 112, 114 are held circumferentially by the inner wall 117 of the first opening 115 of the first housing 102, which applies a large amount of hoop stress directed radially inwardly on the mixing chamber elements, as will be further discussed below. This secondary point of retention and security reduces the required amount of compressive force to hold the mixing chamber elements in place during high pressure and high energy mixing.

For example, due to the hoop stress applied to the mixing chamber elements, each of six bolts 106 in one embodiment need only a torque force of 100 inch-pounds to hold the mixing chamber elements together to create a seal. Prior art devices that use primarily compression to secure the mixing chamber elements as discussed above, however, tend to require significantly higher amounts of torque force to hold the mixing chamber elements together to create a seal (about 130 foot-pounds of torque). Because the prior art devices use a tube member that must be stretched to decrease its diameter and clamp down on the mixing chamber elements, the prior art devices require larger housings, more components and therefore, a higher hold-up volume of approximately 0.5 ml. In one embodiment of the present disclosure, the mixing chamber elements are secured within the first opening of the first housing and achieve the high hoop stress imparted from the inner wall of the first housing onto the outer circumference of the mixing chamber elements, the present disclosure takes advantage of precision fit components and the properties of thermal expansion. The hold-up volume of the interaction chamber of the present disclosure is around 0.05 ml.

An example procedure for assembling one embodiment of the interaction chamber of the present disclosure are now described with reference to the assembled interaction chamber in FIG. 1 and each individual component illustrated in FIGS. 3 to 5 and 10 to 12.

Figure 6:
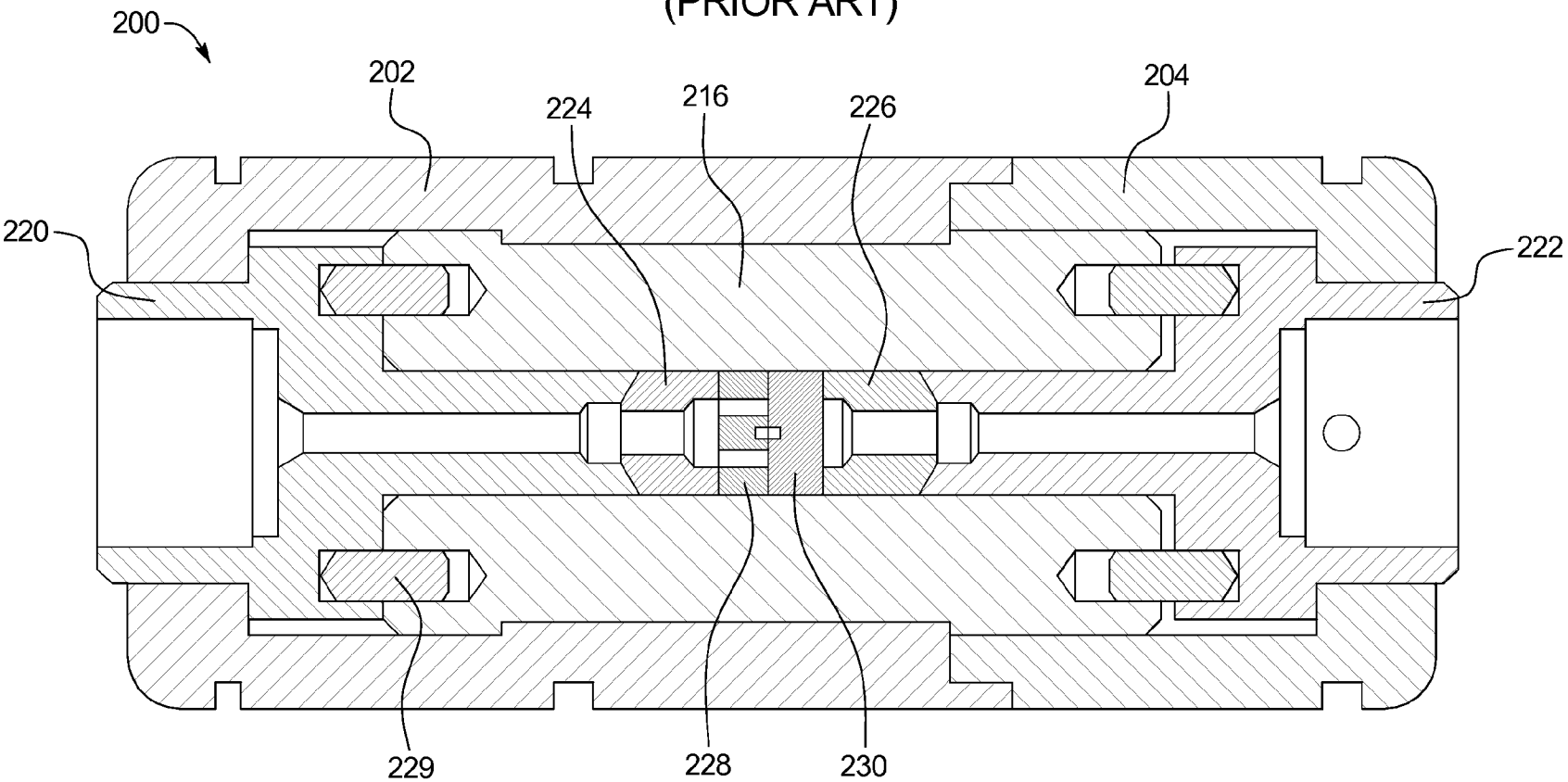
FIG. 6 (PRIOR ART)
FIG. 6 is a cross-sectional view of a prior art mixing device.

First, the inlet retaining member 108, as shown in FIG. 6, may be inserted into the first opening of the first housing, as shown in FIG. 3. The inlet retaining member 108 has a substantially cylindrical shape, and fits concentrically within the first opening of the first housing. When inserted, the inlet retaining member 108 includes a chamfered surface 130 that is configured contact a complimentary chamfered interior surface 119 of the first housing 102. This chamfered mating between the first housing 102 and the inlet retaining member 108 ensures that the inlet retaining member 108 self-centers within the first opening and lines up properly and squarely to the inner wall 117 of the first opening 115. It should be appreciated that the inlet retaining member 108 includes a concentric passageway 132 which allows fluid to flow through the inlet retaining member 108. The passageway 132 lines up with flow path 116 of the first housing 102, through which the unmixed fluid is pumped from a separate component in the mixing system.

Second, the first housing 102 may be heated to at least a predetermined temperature, at which point the first opening 115 expands from a first opening diameter to at least a first opening expanded diameter. In some example embodiments, the first housing is made of stainless steel, and the first housing is heated using a hot plate or any other suitable method of heating stainless steel. In one such embodiment, the predetermined temperature at which the first housing is heated is between 100° C. and 130° C. It should be appreciated that, when the first opening 115 is at the first diameter, the mixing chamber elements 112, 114 are unable to fit within the first opening 115. However, the mixing chamber components 112, 114 are manufactured and toleranced such that, after the first housing 102 is heated and the first diameter expands to the first expanded diameter, the mixing chamber elements 112, 114 are able to fit within the first opening 115. In one embodiment, the first expanded diameter is between 0.0001 and 0.0002 inches larger than the first diameter.

Third, the inlet mixing chamber element 112 is inserted into the first opening 115 of the heated first housing 102. The top surface 304 of the inlet mixing chamber element 112 is configured to be in contact with the bottom surface 132 of inlet retaining member 108. Because the inlet retaining member 108 is self-aligned with the chamfered mating surfaces of 119 and 130, the inlet mixing chamber element 112 is also properly aligned when surface 304 makes complete contact with surface 132 of inlet retaining member 108.

Fourth, the outlet mixing chamber element 114 is inserted into the first opening 115 of the heated first housing 102. The top surface 310 of the outlet mixing chamber element 114 is configured to be in contact with the bottom surface 306 of the inlet mixing chamber element 112. It should be appreciated that in some embodiments, the surface 306 and surface 310 include complimentary features that ensure the inlet mixing chamber element 112 is properly oriented and aligned with the outlet mixing chamber element 114. For example, in one embodiment, the inlet mixing chamber element 112 includes one or more protrusions that fit one or more complimentary recesses in the outlet mixing chamber element 114 so as to ensure proper rotational alignment of the two mixing chamber elements.

Fifth, once the mixing chamber elements 112, 114 are arranged within the first opening 115 of the heated first housing 102, the outlet retaining member 110 may be inserted into the first opening 115. The outlet retaining member 110 is substantially similar in structure to the inlet retaining member 108. Similar to the inlet retaining member 108, surface 132 of the outlet retaining member 110 is configured to make contact with surface 312 of the outlet mixing chamber element 114.

Sixth, the second housing 104 is aligned with the first housing 102 and the assembled first and second housings are operatively fastened together. As seen in FIG. 3, the second housing 104 includes protrusion 125 extending from top surface 126. When the first housing 102 is aligned with the second housing 104, protrusion 125 fits into the first opening 115. Similar to the opposite end of the first opening 115, the protrusion 125 includes a complimentary chamfered surface 123, which is configured to contact the chamfered surface 130 of the outlet retaining member 110. Also similar to the first housing's contact with the inlet retaining member 108, the chamfered surface 123 of protrusion 125 ensures that the outlet retaining member 110 is square to the inner surface 117 of opening 115. When both the inlet retaining member 108 and the outlet retaining member 110 are properly aligned by the first housing 102 and the protrusion 125 of the second housing 104 respectively, the inlet mixing chamber element 112 and the outlet mixing chamber element 114 are correctly aligned within the first opening 115. If the mixing chamber elements 112, 114 are even slightly misaligned, the elements may be damaged due to incorrect holding forces and the high pressure of the mixing. Additionally, the mixing results will be less consistent and reliable if the mixing chamber elements are not perfectly aligned by the retaining members and the first and second housings.

Seventh, the first housing may be operatively fastened to the second housing so that the inlet retainer, the inlet mixing chamber element, the outlet mixing chamber element, the outlet retainer, and the male member of the second housing are in compression. In the illustrated embodiment, six bolts 106 may be used to fasten the first housing 102 to the second housing 104. To ensure equal clamping force between the first housing 102 and the second housing 104, the bolts 106 are spaced sixty degrees apart and equidistant from central axis A. As discussed above, the fastening of six bolts 106 provides sufficient clamping force to seal surface 306 of the inlet mixing chamber element with surface 310 of the outlet mixing chamber element. It will be appreciated that any appropriate fastening arrangement or numbers of bolts may be used.

Eighth, the first housing is allowed to cool down from its heated state. In various embodiments, the first housing is cooled down by allowing it to return to room temperature or actively causing it to cool with an appropriate cooling agent. When the first housing is cooled, the material of the first housing contracts back, and the first housing expanded diameter is urged to contract back to the first housing diameter. Because the mixing chamber elements are already arranged and aligned inside of the first opening of the first housing, the contracting diameter of the first opening exerts a high amount of force directed radially inwardly on the mixing chamber elements. This force, in combination with the compressive force applied from the six bolts 106, is sufficient to hold the mixing chamber elements in place for the high pressure mixing. It should be appreciated that the mixing chamber elements can be made of any suitable material to withstand the radially inward stress of 30,000 pounds per square inch applied when the first opening diameter contracts. In one embodiment, the mixing chamber elements are constructed with 99.8% alumina. In another embodiment, the mixing chamber elements are constructed with polycrystalline diamond.

In operation, when the inlet mixing chamber element 112 and the outlet mixing chamber element 114 are secured and held in the first housing between the inlet and outlet retaining members, surface 306 makes a fluid-tight seal with surface 310. The unmixed fluid is pumped through flow path 116 of the first housing 102, and through inlet retainer 108 to inlet mixing chamber element 112. At inlet mixing chamber element 112, the fluid is pumped at high pressure into ports 300 and 302, and then into the plurality of converging microchannels 308, described in more detail below. Due to the decrease in fluid port size from flow path 116 to ports 300, 302 to microchannels 308, the pressure and shear forces on the unmixed fluid becomes very high by the time it reaches the microchannels 308. As discussed above, and because of the secure holding between the inlet and outlet mixing chamber elements, microchannels 308 and 318 combine to form micro flow paths, through which the unmixed fluid travels. When the micro flow paths converge on one another, the high pressure fluid experiences a powerful reaction, and the constituent parts of the fluid are mixed as a result. After the fluid has mixed in the micro flow paths, the mixed fluid travels through outlet ports 314, 316 of outlet mixing chamber element 114.

Referring now specifically to FIGS. 6 to 9, a prior art mixing chamber is illustrated and discussed. As seen in FIG. 6, a prior art mixing assembly is illustrated. The mixing assembly 200, which includes an inlet cap 202 and an outlet cap 204. The inlet cap 202 includes threads that are configured to engage complimentary threads on the outlet cap 204. The mixing assembly 200 also includes an inlet flow coupler 220, an outlet flow coupler 222, an aligning tube 221, an inlet retainer 224, an outlet retainer 226, an inlet mixing chamber element 228 and an outlet mixing chamber element 230.

The inlet flow coupler 220 is arranged within the inlet cap 202, and the outlet flow coupler 222 is arranged within the outlet flow cap 204. When assembled, the tube 221 stays aligned with both the inlet flow coupler 220 and the outlet flow coupler 222 with the use of a plurality of pins 229. The inlet retainer 224 and the outlet retainer 226 are arranged within the tube 221, and serve to align and retain the inlet mixing chamber element 228 and the outlet mixing chamber element 230. The inlet and outlet retainers 224 and 226 make contact with the inlet flow coupler 220 and the outlet flow coupler 222 respectively.

When the device is fully assembled, a flow path is formed between the inlet flow coupler 220, the inlet retainer 224, the inlet mixing chamber element 228, the outlet mixing chamber element 230, the outlet retainer 226 and the outlet flow coupler 222. The unmixed fluid enters the inlet flow coupler 220 and travels through the inlet retainer 224 and to the inlet mixing chamber element 228. Under high pressure and as a result of the high energy reaction, the unmixed fluid is mixed between the inlet mixing chamber element 228 and the outlet mixing chamber element 230. The mixed fluid then travels through the outlet retainer 226 and the outlet flow coupler 222. As will be described in greater detail below and illustrated in FIGS. 7 to 9, the pre-mix flow of the fluid follows a substantially right-angular flow path as it travels from the inlet port downward and makes an approximately ninety degree turn toward the mixing chamber.

Figure 7:
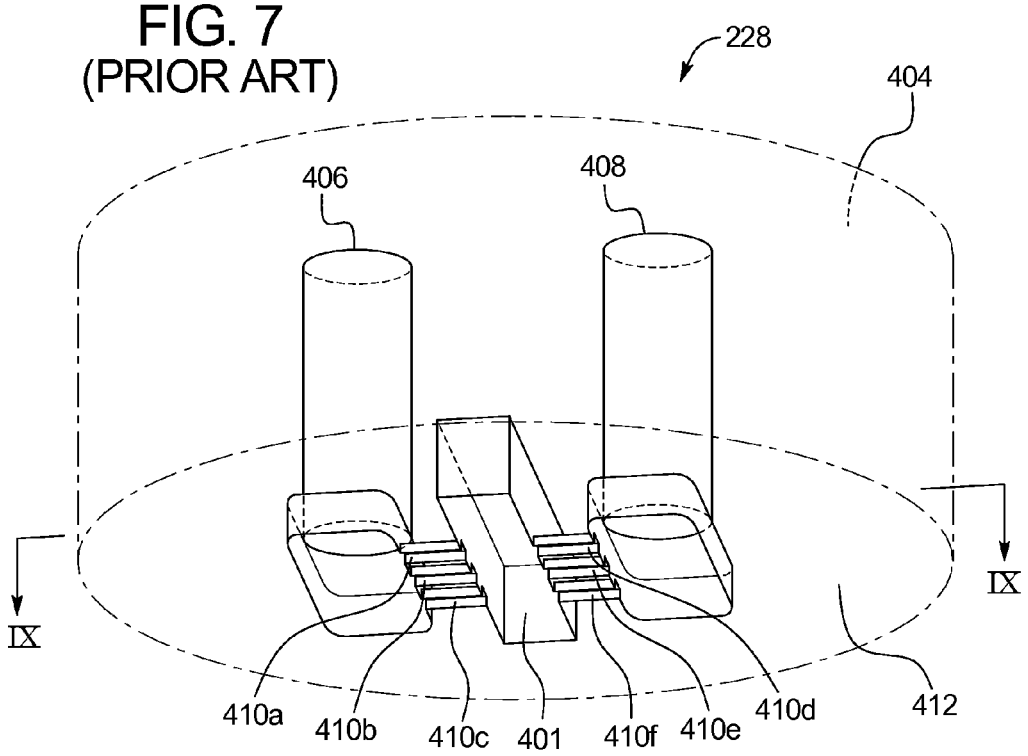
FIG. 7 (PRIOR ART)
FIG. 7 is a perspective cross-sectional view of an inlet mixing chamber element of a prior art device.

In FIG. 7, a prior art inlet mixing chamber element 228 corresponds to the inlet mixing chamber element 228 depicted in FIG. 6. The illustrated prior art inlet mixing chamber element 228 includes a top surface 404, a bottom surface 412 and a plurality of ports 406, 408 extending from the top surface 404 toward the bottom surface 412. On bottom surface 412 of the inlet mixing chamber element 228, one or more microchannels 410*a*, 410*b*, 410*c*, 410*d*, 410*e* and 410*f* are etched substantially parallel to one another. The ports 406, 408 are in fluid communication with microchannels 410*a* to 410*f*.

Figure 8:
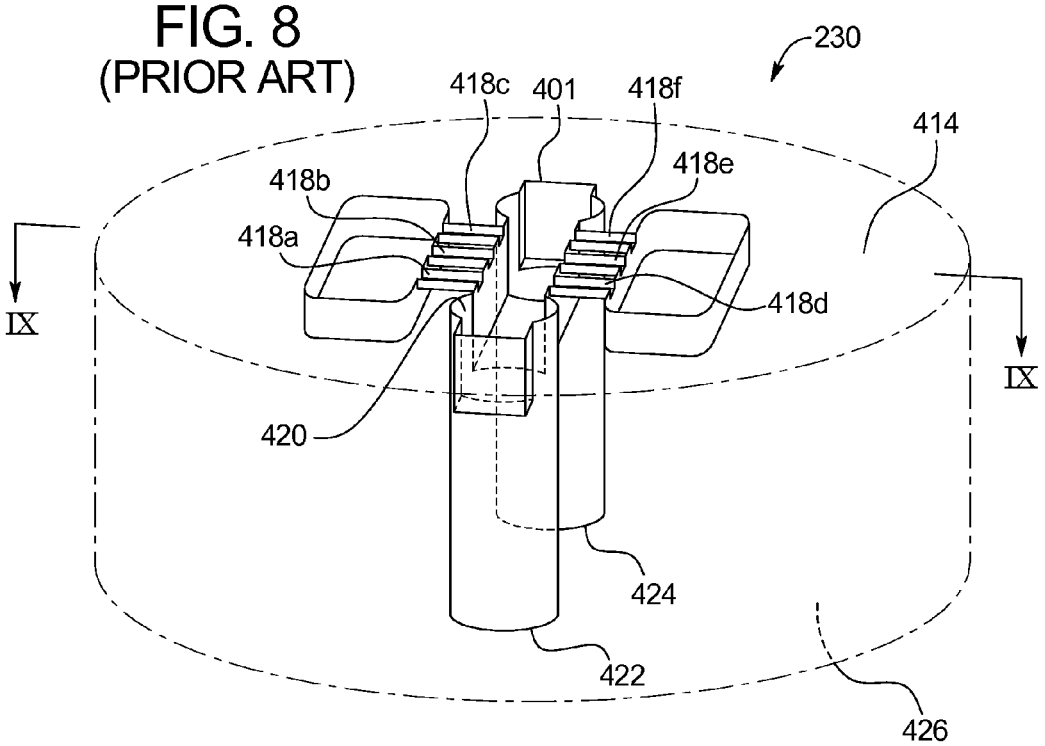
FIG. 8 (PRIOR ART)
FIG. 8 is a perspective cross-sectional view of an outlet mixing chamber element of a prior art device.

Similar to the prior art inlet mixing chamber element 228, a prior art outlet mixing chamber element 230 illustrated in FIG. 8 corresponds to the outlet mixing chamber element 230 depicted in FIG. 6 and discussed briefly above. The prior art outlet mixing chamber element 230 includes top surface 414, bottom surface 426 and a plurality of ports 422, 424 extending from top surface 414 to bottom surface 426. On top surface 414, one or more microchannels 418*a*, 418*b*, 418*c*, 418*d*, 418*e* and 418*f* are etched substantially parallel to one another. The ports 422 and 424 are in fluid communication with the microchannels 418*a* to 418*f*. It should be appreciated that the microchannels 418*a* to 418*f* of the outlet mixing chamber element 230 and the microchannels 410*a* to 418*f* of the inlet mixing chamber element 228 complement one another such that, when the inlet mixing chamber element 228 and the outlet mixing chamber element 230 are pressed sealingly together in the mixing assembly, as shown in FIG. 1, microchannels 410*a* to 410*f* and correspondingly 418*a* to 418*f* create parallel fluid pathways. In the illustrated embodiment, the fluid pathways are defined by 410*a*/418*a*, 410*b*/418*b*, 410*c*/418*c*, 410*d*/418*d*, 410*e*/418*e* and 410*f*/418*f*. In the illustrated prior art embodiment, three parallel fluid pathways are arranged on either side of the mixing chamber. For example, a first trio of fluid pathways 410*a*/418*a*, 410*b*/418*b* and 410*c*/418*b* are arranged in parallel to one another on the port 406 side of the mixing chamber 401. Similarly, a second opposing trio of fluid pathways 410*d*/418*d*, 410*e*/418*e* and 410*f*/418*f* are arranged in parallel to one another on the port 408 side of the mixing chamber 401 facing the first trio of parallel fluid pathways. Each parallel fluid pathway in the first trio of fluid pathways has a complementary parallel fluid pathway directly opposite the mixing chamber in the second trio of fluid pathways. For example, fluid pathway 410*a*/418*a* is complementary to fluid pathway 410*d*/418*d*; fluid pathway 410*b*/418*b* is complementary to fluid pathway 410*e*/418*e*; and fluid pathway 410*c*/418*c* is complementary to fluid pathway 410*f*/418*f*.

In one example of the assembled prior art device, the fluid is pumped under high pressure through the fluid pathway defined from the top surface 404 of the inlet mixing chamber element 228 through ports 406 and 408 to the fluid pathways 410*a*/418*a* to 410*f*/418*f*. The fluid discharged from each of the parallel fluid pathways flows under high pressure and high speed so that when it collides with fluid flowing from its complementary parallel fluid path, the two fluid streams mix in the mixing chamber 401. In the mixing chamber 401, the force of the collision causes the fluid to break down into small particles and become mixed together. The mixed fluid from each of the three collisions defined by flow path 410*a*/418*a* with flow path 410*d*/418*d*; flow path 410*b*/418*b* with flow path 410*e*/418*e*; and flow path 410*c*/418*c* with flow path 410*f*/418*f*, then exits the output mixing chamber element 230 through ports 422 and 424.

Figure 9:
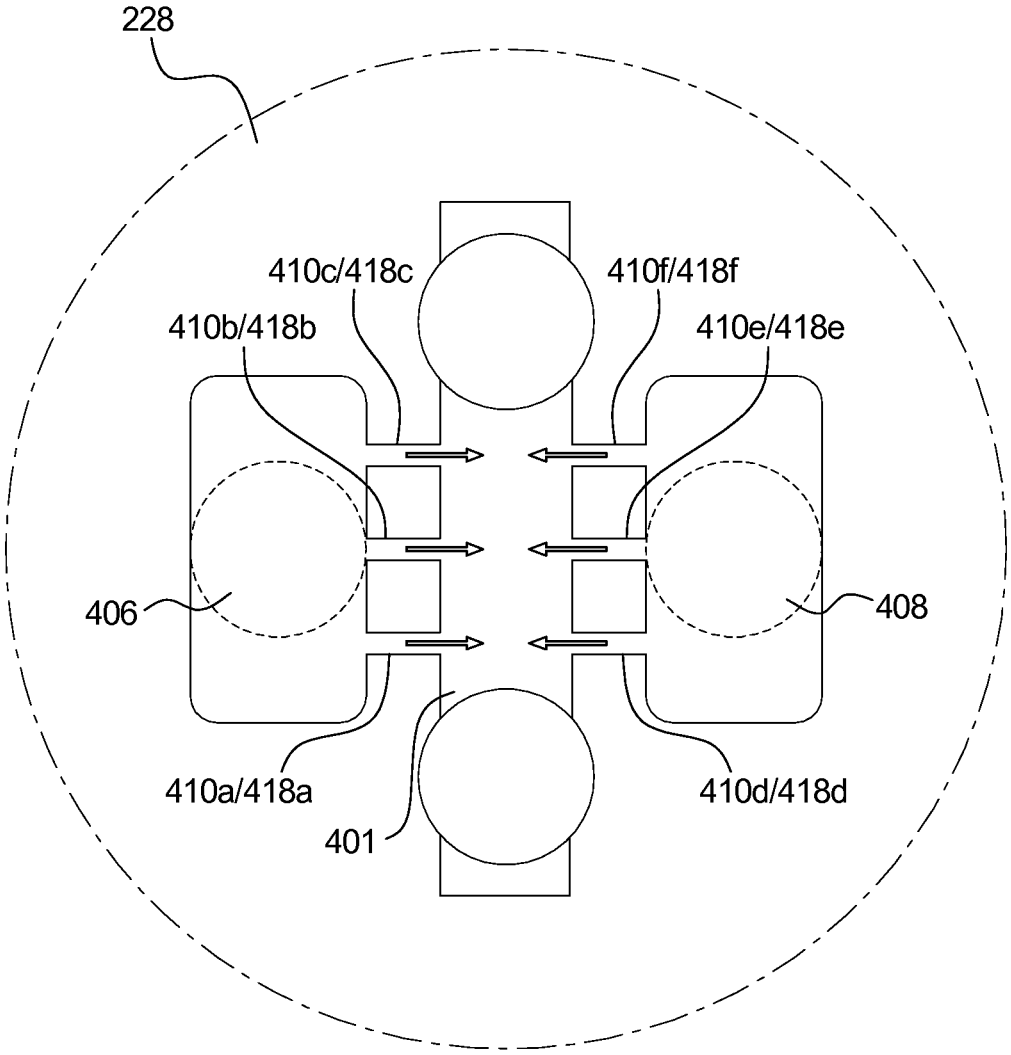
FIG. 9 (PRIOR ART)
FIG. 9 is a top cross-sectional view of the inlet and outlet mixing chamber elements of the prior art device taken along line IX-IX of FIGS. 7 and 8.

Referring now to FIG. 9, a top cross-sectional view of the inlet mixing chamber element 228 and the outlet mixing chamber element 230 of a prior art device are illustrated. As more clearly illustrated in FIG. 9, the cross section of the microchannels 410 exiting from the ports 406 and 408 travel parallel to one another from the ports to the mixing chamber 401. The fluid passes through port 406 and 408 of the inlet mixing chamber element 228 until it encounters the top of the outlet mixing chamber element 230. When the fluid flow reaches the top of the outlet mixing chamber element, it is interrupted and is forced to flow through the parallel flow paths 410*a*/418*a* to 410*f*/418*f* into the mixing chamber 401. In the prior art device, the parallel flow paths 410*a*/418*a* to 410*f*/418*f* have a constant cross-sectional shape, and terminate at the outer radial end of port 406 and port 408 respectively. This prior art construction of the parallel flow paths enables the fluid flowing through flow path 410*a*/418*a* at high pressure to collide in the mixing chamber 401 with the fluid flowing through flow path 410*d*/418*d*. Similarly, the fluid flowing through flow path 410*b*/418*b* at high pressure collides in the mixing chamber 401 with the fluid flowing through flow path 410*e*/418*e*. The fluid flowing through flow path 410*c*/418*c* at high pressure collides in the mixing chamber 401 with the fluid flowing through flow path 410*f*/418*f*. At each one of these points of collision within the mixing chamber 401, the fluid is mixed and directed out of the outlet mixing chamber element 230 through ports 422 and 424.

It should be appreciated that, when the fluid is mixed by colliding one flow path 410*a*/418*a* with a second flow path 410*d*/418*d*, the energy dissipated at the point of collision is limited by the speed and trajectory of the liquid flowing in each of the associated flow paths. When collisions of this nature results in increased dissipated energy, the particles in the fluid are broken down further, and the resulting mixture of the fluid is more thorough and consistent. Therefore, it is advantageous to maximize the amount of energy dissipated at the collision point of mixture within the mixing chamber.

Referring now to FIGS. 10 to 12, an example mixing chamber embodiment of the present invention is discussed and illustrated. In FIG. 10, the inlet mixing chamber element 112 includes a top surface 304, configured to contact the inlet retaining element 108 when inserted into the first opening 115 of the first housing 102. The inlet mixing chamber element 112 also includes a plurality of ports 300, 302 extending from surface 304 toward bottom surface 306. Ports 300, 302 may be small, and it should be appreciated that FIGS. 10 to 12 have been drawn out of scale for illustrative and explanatory purposes. On bottom surface 306 of the inlet mixing chamber element 112, a plurality of microchannels 308*a*, 308*b*, 308*c*, 308*d*, 308*e* and 308*f* are etched. The ports 300, 302 are in fluid communication with microchannels 308*a* to 308*f*. The microchannels extend from an area of fluid communication with the ports 300, 302 toward a concentration area 317 within the mixing chamber 301. It should be appreciated that, in various embodiments, the microchannels 308*a* to 308*f* are each oriented radially outwardly from the concentration area 317 toward the outer circumferential edge of the inlet mixing chamber element 112. In other various embodiments, the microchannels 308*a* to 308*f* extend radially outwardly from the concentration area 317 toward the outer edge of each respective port 300, 302.

In FIG. 11, the outlet mixing chamber element includes a top surface 310, a bottom surface 311 and a plurality of ports 314, 315 extending from top surface 310 to bottom surface 311. In one embodiment, a plurality of microchannels 312*a*, 312*b*, 312*c*, 312*d*, 312*e* and 312*f* are etched into top surface 310 of the outlet mixing chamber element 114. The microchannels 312*a* to 312*f* are in fluid communication with outlet ports 314 and 315 through mixing chamber 301. Similar to channels 308*a* to 308*f*, the microchannels 312*a* to 312*f* are each oriented radially outwardly from the concentration area 317 toward the outer circumferential edge of the outlet mixing chamber element 114.

In operation, the inlet mixing chamber element 112 and the outlet mixing chamber element 114 of one embodiment are abutted against one another under high pressure in the mixing assembly. In one embodiment, the microchannels 308*a* to 308*f* of the inlet mixing chamber element 112 and the corresponding microchannels 312*a* to 312*f* of the outlet mixing chamber element 114 complement one another to create fluid-tight micro flow paths when the mixing chamber elements 112, 114 are fully assembled. Microchannels 312*a* to 312*f* on surface 310 of the outlet mixing chamber element 114 are configured to line up with corresponding microchannels 308*a* to 308*f* on surface 306 of the inlet mixing chamber element 112 of FIG. 10 when the two mixing chamber elements are aligned and sealingly abutted against one another. The resulting micro flow paths are defined by flow path 308*a*/312*a*, flow path 308*b*/312*b*, flow path 308*c*/312*c*, flow path 308*d*/312*d*, flow path 308*e*/312*e* and flow path 308*f*/312*f*. The flow paths created provide a fluid path leading from the top surface of the inlet mixing chamber element 112, through the ports 300, 302, through the flow paths 308*a*/312*a*, 308*b*/312*b*, 308*c*/312*c*, 308*d*/312*d*, 308*e*/312*e* and 308*f*/312*f* into the mixing chamber 301, and out the ports 314, 315 of the outlet mixing chamber element 114.

As discussed generally above and illustrated in detail in FIGS. 10 to 12, the microchannels 308*a* to 308*f* and 312*a* to 312*f* may be specifically constructed in the inlet mixing chamber element 112 and the outlet mixing chamber element 114 respectively to encourage a convergent flow of the liquid from the ports 300, 302 to each of the micro fluid paths toward a single area in the mixing chamber to be mixed and then through mixing chamber element 314. Specifically, due to the orientation of the flow paths 308*a*/312*a* to 308*f*/312*f*, the fluid exiting each of the flow paths collide in a single concentration area 317 in the mixing chamber 301. In FIG. 12, a top cross-sectional view of the inlet mixing chamber element 112 and the outlet mixing chamber element 114 of one example embodiment of the present invention are illustrated. In various embodiments, after the fluid is pumped into the ports 300, 302 of the inlet mixing chamber element, it travels downward toward the top surface 310 of the outlet mixing chamber element 114. When the fluid flow encounters the outlet mixing chamber element 114, it changes direction and is discharged out of the plurality of micro flow paths 308*a*/312*a*, 308*b*/312*b*, 308*c*/312*c*, 308*d*/312*d*, 308*e*/312*e* and 308*f*/312*f*, where the fluid from each of the flow paths are mixed together in the concentration area 317.

As seen in FIG. 12, one example embodiment of the present invention includes flow paths that are not parallel to one another in the area bounded by the lower exit of the ports 300, 302 and the entrance to the mixing chamber 301. In various embodiments, the microchannels are etched into the inlet mixing chamber element 112 to direct the fluid flowing through each of the six respective micro flow path toward a single concentration area 317 in the mixing chamber. In one embodiment of the present invention, the micro flow paths 308*a*/312*a* to 308*f*/312*f* have a generally rectangular cross-section. In another embodiment, the micro flow paths 308*a*/312*a* to 308*f*/312*f* have a generally round cross-section.

It should be appreciated that in various embodiments, because the plurality of micro fluid paths direct the respective fluid to a concentration area 317, each of the flow paths converge and interact with one another in the mixing chamber 301. In various embodiments, the fluid flowing through each of the converging micro flow paths 308*a*/312*a* to 308*f*/312*f* is travelling at very high speeds. Distinguishable from current devices, in which the high speed fluid flow of each micro flow path only interacts initially with the complementary opposing micro flow path, the converging micro flow paths of the present disclosure provide a much greater impact zone at the concentration area of the mixing chamber. As discussed above and generally understood, as the energy dissipated in the collision of fluid flows in the mixing chamber increases, the breakdown of the particles is optimized, therefore resulting in desirable fluid mixing consistency and reliability. In current devices, each point of collision includes only two high-speed fluid flows, and therefore the energy dissipated at the collision point in the mixing chamber is limited. However, it should be appreciated that in various embodiments of the present disclosure, the concentration area in the mixing chamber includes the convergence six high-speed fluid flows, thereby increasing the impact force of the fluid against other fluid flows, and maximizing energy dissipation and particle breakdown. In various embodiments, the number of converging micro flow paths is more than six.

It should be appreciated that in various embodiments, given the consistency of mixing required, the flow rate of the fluid and the pressure can be decreased compared to prior art devices requiring the same mixing consistency. As the number of high-speed impinging fluid flows converging on a concentration area increases, the speed of the fluid flow required for a threshold level of energy dissipation is reduced. For example, in current devices, to achieve a given level of energy dissipation and quality of mixing in the mixing chamber, the fluid flowing through the parallel micro flow paths must travel at a certain high speed. However, in the device of one embodiment disclosed herein, to achieve the same level of energy dissipation and quality of mixing in the mixing chamber, the fluid flowing through the converging micro flow paths toward the concentration area may travel at a lower speed than the current device due to the multiple paths interacting with one another in the concentration area. In addition to saving cost and resources, the present disclosure performs consistently and reliably, and can advantageously be configured to operate with current machines needing no modification.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

We claim:

1. A mixing chamber assembly comprising:

(a) a first mixing chamber element having a first height, including:

(1) a first top surface having a first top surface diameter;

(2) a first bottom surface having a first bottom surface diameter equal to the first top surface diameter;

(3) at least first and second inlet ports extending axially downward from the first top surface toward the first bottom surface, each of the at least first and second inlet ports offset from a central axis of the first mixing chamber element;

(4) a first mixing chamber extending axially upward from the center of the first bottom surface a distance less than the first height, the first mixing chamber including a concentration area;

(5) a first plurality of converging upper microchannels defined on the first bottom surface extending radially inwardly from the first inlet port along the bottom surface to the concentration area; and (6) a second plurality of converging upper microchannels defined on the first bottom surface extending radially inwardly from the second inlet port along the bottom surface to the concentration area;

(b) a second mixing chamber element having a second height, including:

(1) a second top surface having a second top surface diameter equal to the first top surface diameter;

(2) a second bottom surface having a second bottom surface diameter equal to the first top surface diameter;

(3) at least third and fourth outlet ports extending axially downward from the second top surface through the second bottom surface, each of the at least third and fourth outlet ports offset from a central axis of the second mixing chamber element;

(4) a second mixing chamber extending axially downward from the center of the second top surface a distance of less than the second height, the second mixing chamber sharing the concentration area of the first mixing chamber;

(5) a first plurality of converging lower microchannels defined on the second top surface extending radially inwardly from the third outlet port along the top surface to the concentration area; and (6) a second plurality of converging lower microchannels defined on the second top surface extending radially inwardly from the fourth outlet port along the top surface to the concentration area; and (c) wherein, when the first mixing chamber element and the second mixing chamber element are sealingly aligned:

(1) the first plurality of converging lower microchannels and the first plurality of converging upper microchannels align to create a first plurality of converging micro fluid flow paths;

(2) the second plurality of converging lower microchannels and the second plurality of converging upper microchannels align to create a second plurality of converging micro fluid flow paths; and (3) the first mixing chamber and the second mixing chamber align.

2. A mixing chamber assembly, comprising:

(a) a first mixing chamber element having a first surface and a first inlet port and a second inlet port both extending toward the first surface through the first mixing chamber element;

(b) a second mixing chamber element having a second surface and an outlet port, the first surface sealingly engaged with the second surface, and the outlet port extending through the second mixing chamber element in a direction away from the second surface;

(c) a mixing chamber defined between the first and second mixing chamber elements;

(d) a concentration area defined within the mixing chamber;

(e) a plurality of first converging microfluid channels defined between the first and second mixing chamber elements and providing fluid communication between the first input port and the mixing chamber, each of the first converging microfluid channels oriented toward the concentration area; and (f) a plurality of second converging microfluid channels defined between the first and second mixing chamber elements and providing fluid communication between the second input port and the mixing chamber, each of the second converging microfluid channels oriented toward the concentration area;

wherein the first and second mixing chamber elements are configured to accept a high pressure fluid flow along first and second flow paths, the first flow path:

(1) extending through the first inlet port in the first mixing chamber element, (2) extending from the first inlet port through the plurality of first converging microfluid channels to the concentration area;

(3) extending from the mixing chamber through the outlet port, and the second flow path (1) extending through the second inlet port in the first mixing chamber element, (2) extending from the second inlet port through the plurality of second converging microfluid channels to the concentration area;

(3) extending from the mixing chamber through the outlet port.

3. The mixing chamber assembly of claim 1, further comprising a first transition area, the first inlet port being in fluid communication with the plurality of first converging microchannels through the first transition area.

4. The mixing chamber assembly of claim 3, wherein the first inlet port further comprises a plurality of first inlet ports in fluid communication with the plurality of first converging microchannels through the first transition area.

5. The mixing chamber assembly of claim 4, wherein the second inlet port further comprises a plurality second inlet ports in fluid communication with the plurality of second converging microchannels through a second transition area.

6. The mixing chamber assembly of claim 1, wherein the plurality of first converging microfluid channels each converge in a straight line from the first input port to the mixing chamber, and the plurality of second converging microfluid channels each converge in a straight line from the second input port to the mixing chamber.

7. The mixing chamber assembly of claim 6, wherein the first input port includes a first transition chamber and the second input port includes a second transition chamber, and wherein the plurality of first converging microfluid channels each converge in a straight line from the first transition chamber to the mixing chamber, and the plurality of second converging microfluid channels each converge in a straight line from the second transition chamber to the mixing chamber.

8. The mixing chamber assembly of claim 2, wherein:

the first inlet port further comprises a plurality of ports in the first mixing chamber element in fluid communication with the plurality of first converging microchannels.

9. The mixing chamber assembly of claim 2, wherein the first and second mixing chamber elements are cylindrical.

10. The mixing chamber assembly of claim 2, wherein first and second inlet ports are substantially perpendicular the first and second surfaces.

11. The mixing chamber assembly of claim 2, wherein the pluralities of first and second microchannels are parallel to the first and second surfaces.

12. The mixing chamber assembly of claim 2, wherein the plurality of first converging microchannels are substantially perpendicular to the first inlet port and the plurality of second converging microchannels are substantially perpendicular to the second inlet port.

13. The mixing chamber assembly of claim 2, wherein the mixing chamber is defined in the center of the first and second mixing chamber elements.

14. The mixing chamber assembly of claim 2, wherein the pluralities of first and second microchannels are etched in the first surface.

15. The mixing chamber assembly of claim 2, wherein the pluralities of first and second microchannels are etched in the second surface.

16. The mixing chamber assembly of claim 2, wherein the pluralities of first and second microchannels are etched in both the first and the second surfaces.

17. The mixing chamber assembly of claim 2, wherein the outlet port further comprises a plurality of outlet ports in the second mixing chamber element.

18. The mixing chamber assembly of claim 17, wherein the concentration area is located in the center of the mixing chamber and wherein the plurality of outlet ports are offset from the center of the mixing chamber.

19. The mixing chamber assembly of claim 2, wherein the plurality of first converging microfluid channels each converge in a straight line from the first input port to the mixing chamber, and the plurality of second converging microfluid channels each converge in a straight line from the second input port to the mixing chamber.

20. The mixing chamber assembly of claim 19, wherein the first input port includes a first transition chamber and the second input port includes a second transition chamber, and wherein the plurality of first converging microfluid channels each converge in a straight line from the first transition chamber to the mixing chamber, and the plurality of second converging microfluid channels each converge in a straight line from the second transition chamber to the mixing chamber.

21. A mixing chamber assembly comprising:

(a) a first mixing chamber element, including:

(1) at least a first inlet port and a second inlet port;

(2) a first mixing chamber;

(3) a first plurality of converging upper microchannels extending radially inwardly from the first inlet port along a bottom surface of the first mixing chamber element to the first mixing chamber; and (4) a second plurality of converging upper microchannels extending radially inwardly from the second inlet port along the bottom surface of the first mixing chamber element to the first mixing chamber;

(b) a second mixing chamber element, including:

(1) at least a first transition chamber and a second transition chamber;

(2) a second mixing chamber;

(3) a first plurality of converging lower microchannels extending radially inwardly from the first transition chamber along a top surface of the second mixing chamber element to the second mixing chamber; and (4) a second plurality of converging lower microchannels extending radially inwardly from the second transition chamber along the top surface to the second mixing chamber; and (c) wherein, when the first mixing chamber element and the second mixing chamber element are sealingly aligned:

(1) the first mixing chamber and the second mixing chamber align to create an aligned mixing chamber;

(2) the first plurality of converging lower microchannels and the first plurality of converging upper microchannels align to create a first plurality of converging micro fluid flow paths fluidly connected to the first inlet port and the aligned mixing chamber; and (3) the second plurality of converging lower microchannels and the second plurality of converging upper microchannels align to create a second plurality of converging micro fluid flow paths fluidly connected to the second inlet port and the aligned mixing chamber.

22. The mixing chamber assembly of claim 21, wherein the plurality of first converging microfluid channels each converge in a straight line from the first transition chamber to the mixing chamber, and the plurality of second converging microfluid channels each converge in a straight line from the second transition chamber to the mixing chamber.

23. The mixing chamber assembly of claim 22, wherein the first input port includes a first transition chamber and the second input port includes a second transition chamber, and wherein the plurality of first converging microfluid channels each converge in a straight line from the first transition chamber to the mixing chamber, and the plurality of second converging microfluid channels each converge in a straight line from the second transition chamber to the mixing chamber.

24. A mixing chamber assembly, comprising:

first and second inlet ports;

a mixing chamber in fluid communication with the first and second inlet ports, the mixing chamber having a concentration area defined therein;

a plurality of first converging microfluid channels providing the fluid communication between the first input port and the mixing chamber, each of the first converging microfluid channels converging in a straight line from the first input port to the mixing chamber; and a plurality of second converging microfluid channels providing the fluid communication between the second input port and the mixing chamber, each of the second converging microfluid channels converging in a straight line from the first input port to the mixing chamber, wherein the mixing chamber assembly is configured to accept a high pressure fluid flow along first and second flowpaths, the first flowpath (1) extending through the first inlet port, (2) extending from the first inlet port through the plurality of first converging microfluid channels to the concentration area, and (3) extending from the mixing chamber through at least one outlet port, and the second flow path (1) extending through the second inlet port in the first mixing chamber element, (2) extending from the second inlet port through the plurality of second converging microfluid channels to the concentration area, and (3) extending from the mixing chamber through the at least one outlet port.

* * * * *